US006332732B1

(12) United States Patent
Mantovani

(10) Patent No.: US 6,332,732 B1
(45) Date of Patent: Dec. 25, 2001

(54) DEVICE FOR RAPID TOOL COUPLING AND RELEASE ON TOOL ARMS

(75) Inventor: Alberto Mantovani, Finale Emilia (IT)

(73) Assignee: Mantovanibenne S.r.l., Mirandola (IT)

( * ) Notice: Subject to any disclaimer, the term of this patent is extended or adjusted under 35 U.S.C. 154(b) by 0 days.

(21) Appl. No.: 09/496,190

(22) Filed: Feb. 2, 2000

(30) Foreign Application Priority Data

Mar. 2, 1999 (IT) ..... MO99A000034

(51) Int. Cl.[7] ..... F16B 2/18

(52) U.S. Cl. ..... 403/322.3; 403/322.1; 172/275

(58) Field of Search ..... 403/322.3, 322.1; 414/723; 172/275, 274, 272, 273

(56) References Cited

U.S. PATENT DOCUMENTS

| | | | |
|---|---|---|---|
| 4,545,720 | | 10/1985 | Cochran et al. . |
| 5,107,610 | * | 4/1992 | Fusco ..... 414/723 X |
| 5,692,855 | * | 12/1997 | Burton ..... 403/322.1 X |
| 5,967,738 | | 10/1999 | Warthold . |

FOREIGN PATENT DOCUMENTS

| | | |
|---|---|---|
| 93 14 409 | 4/1994 | (DE) . |
| 0 143 074 | 5/1985 | (EP) . |
| 0 549 486 | 4/1994 | (EP) . |
| 0 616 084 | 9/1994 | (EP) . |
| 0 666 377 | 1/1995 | (EP) . |
| 95 18894 | 7/1995 | (WO) . |

* cited by examiner

*Primary Examiner*—Lynne H. Browne
*Assistant Examiner*—John R. Cottingham
(74) *Attorney, Agent, or Firm*—Browdy and Neimark

(57) ABSTRACT

The device for rapid tool coupling and release on tool arms comprises a first rapid-attachment organ associated to a tool arm and is provided with at least one tooth and with hollow coupling seatings destined to couple in seatings and also with at least one pivot predisposed on the tool. The rapid-attachment organ is provided with at least a portion of coupling surface destined to couple on contact with at least a portion of plane on the seatings; the coupling surface is oriented in such a way that a perpendicular thereof does not intersect an axis of the pivot coupled in a hollow seating. Each of the at least one tooth of the coupling element, which is axially mobile internally of a guide having an axis lying in a perpendicular plane to the axis of the pivot coupled in a hollow seating, has an inclined plane destined to couple with a corresponding flat surface afforded on the at least one seating; the inclined plane being inclined with respect to the axis of the guide and generating together with the axis of the guide a slight tapering of a free end of the at least one tooth destined to couple by insertion thereof in the at least one seating.

3 Claims, 2 Drawing Sheets

Fig.3
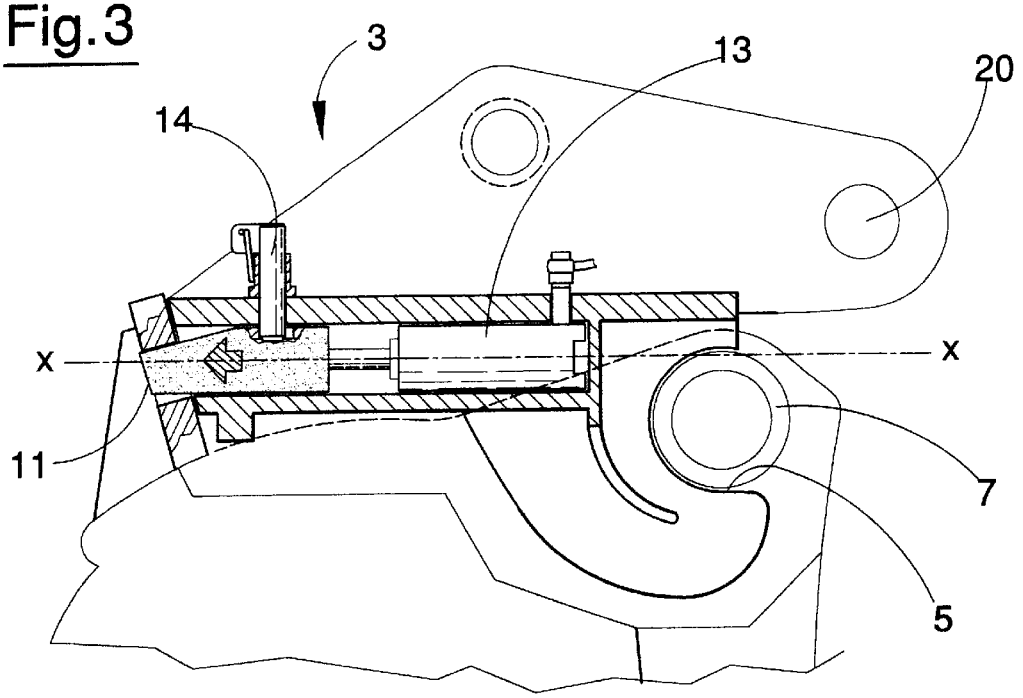
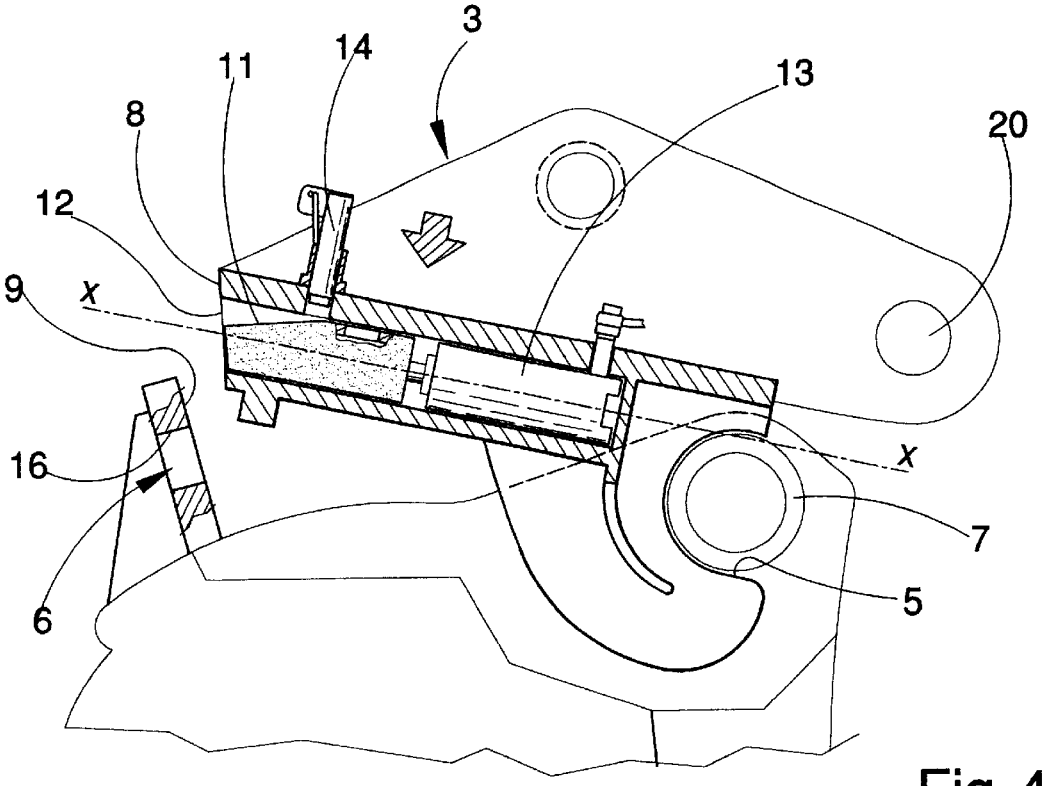
Fig. 4

DEVICE FOR RAPID TOOL COUPLING AND RELEASE ON TOOL ARMS

BACKGROUND OF THE INVENTION

Specifically, though not exclusively, the invention is applicable to the field of rapid attachment apparatus for machines for moving materials, such as, for example, buckets fitted onto the extremities of tool arms on work machinery. Numerous rapid attachment devices are taught in the prior art, which are suitable for the purpose but which are unable to solve definitively and satisfactorily the problem of automatic increase in play in the couplings between the parts, due to the not inconsiderable wear involved. The main aim of the present invention is to obviate the above-described limits in the prior art.

SUMMARY OF THE INVENTION

The invention has the advantages of being simply constructed and functional. A further advantage of the invention is the ease with which the coupling and uncoupling manoeuvres between the arm and the tool are carried out. A further advantage is the stability and safety of the coupling achieved. These aims and advantages and others besides are all achieved by the present invention, as it is characterised in the appended claims.

BRIEF DESCRIPTION OF THE DRAWINGS

Further characteristics and advantages of the present invention will better emerge from the detailed description that follows of an embodiment of the invention, illustrated by way of example and not to be considered limiting in the accompanying figures of the drawings, in which:

FIG. 3 is an enlarged-scale view of a detail of FIG. 1;

FIG. 4 is the same detail of FIG. 3 shown in a different operative configuration.

DESCRIPTION OF THE PREFERRED EMBODIMENTS

Figure 1:
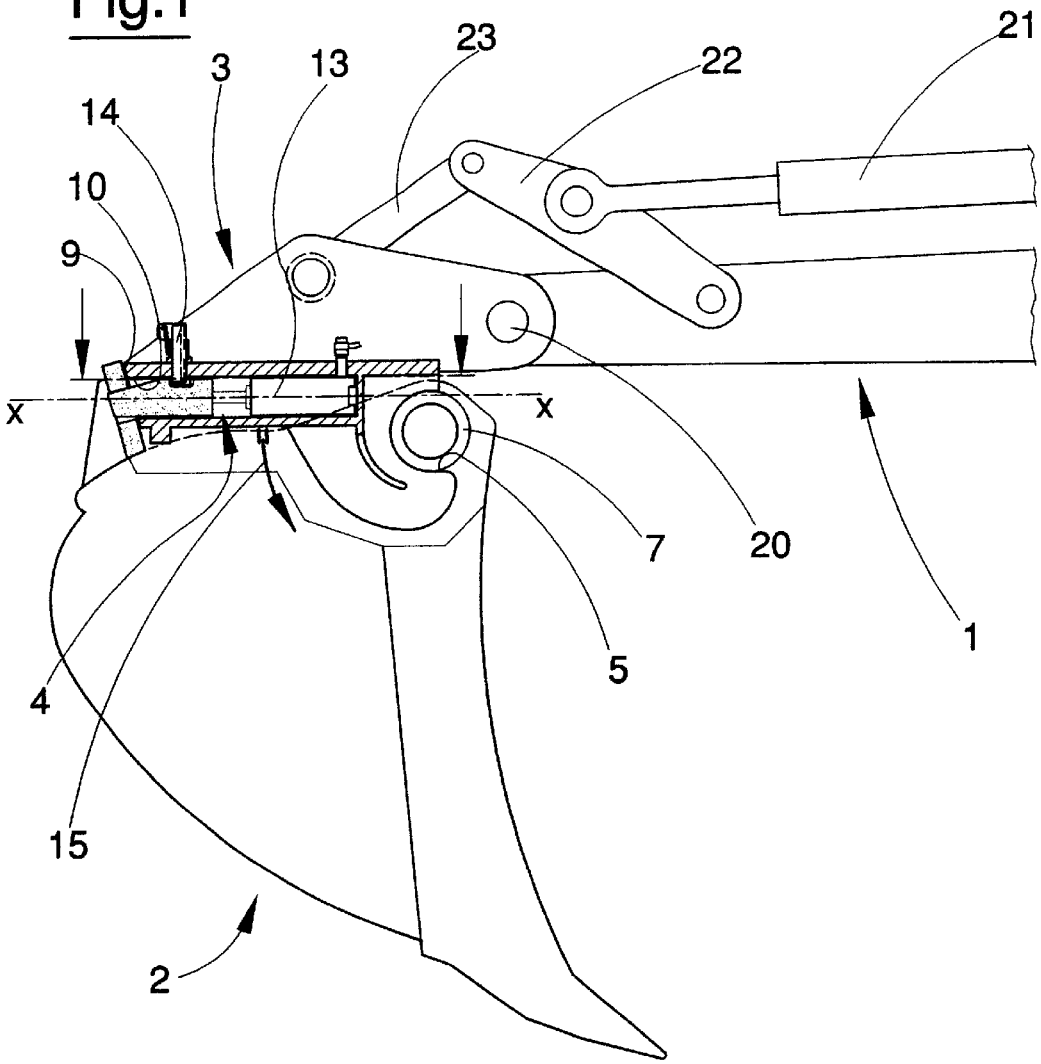
FIG. 1 is a partially-sectioned schematic side view.
Figure 2:
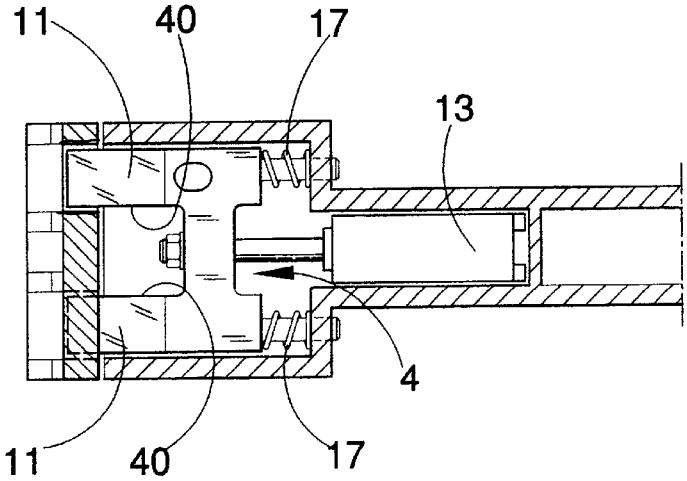
FIG. 2 is an enlarged-scale view of a schematic section made according to line x—x of FIG. 1.

With reference to the figures of the drawings, 1 denotes in its entirety a tool-bearing arm, of a type equipped on work machines. The arm 1 bears at an end thereof a rapid-attachment organ 3, hinged to the arm 1 by a pivot 20. The organ 3 is rotated about the pivot 20 by a hydraulic cylinder 21 acting on a lever 22 which in turn is connected to the organ 3 by means of a con rod 23. The organ 3 is provided with a coupling element 4, exhibiting teeth 40, and with hollow seatings 5 for coupling in seatings 6 and a pivot 7 predisposed on the tool 2 to be coupled.

The organ 3 is further provided with a portion of coupling surface 8, destined to couple contactingly with a portion of plane 9 surface of the seatings 6.

This portion of coupling surface 8 is angled so that its perpendicular does not intersect the axis of the hollow seatings 5, which axis coincides with the axis of the pivot 7 when the coupling has been achieved.

Similarly, the portion of plane 9 surface of the seatings 6 is angled with respect to the axis of the pivot 7 by a predetermined amount. The perpendicular of the central point at the portion of plane 9 surface does not intersect the pivot 7 axis.

The angles of the portion and surface 8 and the portion of plane 9 are predisposed such that when the coupling of the seatings 5 on the pivot 7 are achieved, the portion of surface 8 can be brought into contact with the portion of plane 9. In this configuration the described angle of the portion of surface 8 and the portion of plane 9 with respect to the axis of the pivot 7 prevents any rotation of the bucket 2 about the pivot with respect to the organ 3 in the direction indicated by the arrow 15, while all rotation in the opposite direction is freely permitted. This leads to an important fact: by exerting an adequate pushing action on the portion of surface 8 against the portion of plane 9, all play in the coupling between the bucket 2 and the rapid-attachment organ 3 is prevented.

This adequate pushing action is exerted by the two teeth 40 on the element 4, which latter is mobile axially internally of a guide 10, solidly constrained to the organ 3, the axis x—x of which lies in a plane which is perpendicular to the axis of the seatings 5 (which plane coincides, once the coupling is achieved, with the axis of the pivot 7).

The element 4 is forked, with the two teeth 40 being identical and symmetrically arranged with respect to a plane containing the axis x—x of the guide 10, which plane x—x is perpendicular to the axis of the pivot 7 when the coupling is complete.

The teeth 40 of the element 4 are pushed towards the corresponding seatings 6 by springs 17 acting parallel to the axis x—x of the guide 10.

A linear actuator 13, predisposed coaxially internally of the guide 10, commands the uncoupling axial movement of the teeth 40 from the seatings 6. Each tooth 40 exhibits an inclined plane 11 which is destined to couple in a corresponding flat surface 16 in each seating 6. The plane 11 is inclined with respect to the axis of the guide 10, and thus generates a slight tapering of the free end of the relative tooth 40 destined to couple by insertion into the corresponding seating 6.

The free end of the single tooth 40 is further delimited by a portion of flat surface 12 which is substantially parallel to the portion of surface 8.

The inclination of the plane 11 with respect to the axis x—x of the guide 10 is such that on contact with the corresponding surface 16 each of the teeth 40, pushed by the springs 17, functions as a sort of wedge tending to press the portion of surface 8 against the portion of plane 9. By virtue of the position of the portion of surface 8 and the portion of plane 9 with respect to the axis of the pivot 7, this action naturally tends to prevent the formation of any play in the coupling between the rapid-attachment organ 3 and the bucket 2.

The ratio between the distance of the axis x—x of the guide 10 and the axis of the pivot 7 coupled in the seatings 5 and the distance between the axis x—x and the centre of the portions of surface 8 is preferably comprised between 1/10 and ½.

The coupling of the bucket 2 to the rapid-attachment organ 3 is extremely simple. After having coupled the pivot 7 in the seatings 5, it is sufficient to rotate both until the portions of surface 8 of the rapid-attachment organ 3 contact the most external parts of the portions of plane 9 so as to enable the introduction of the teeth 40 into the seatings 6. The action of the springs 17 will automatically complete the coupling, which occurs through the contacting of the inclined planes 11 with the corresponding surfaces 16, which guarantees the necessary action to prevent any play occurring.

A safety blocking pivot 14 can be inserted at this point, in specially-made seatings. The blocking pivot 14 would reciprocally block the element 4 to the guide 10 of the organ 3, permitting axial movement of the teeth 40 as they constantly take up play.

The coupling can be released equally simply, by extracting the safety blocking pivot 14 and axially retracting the element 4 until the teeth 40 are disengaged from the seatings 6, using the actuator 13.

What is claimed is:

1. A device for rapid tool coupling and release on tool arms, comprising a first rapid-attachment organ associated to a tool arm and being provided with a coupling element and hollow seatings destined respectively to couple in at least one seating and with a pivot, both at least one seating and pivot being predisposed on a tool, said first rapid-attachment organ having at least a portion of a coupling surface which is destined to couple contactingly with a portion of a plane afforded on the at least one seating and oriented such that a perpendicular thereof does not intersect an axis of the pivot, wherein the coupling element is axially mobile internally of a guide, which guide has an axis lying in a perpendicular plane to the axis of the pivot, and the coupling element being provided with at least one tooth having an inclined plane destined to couple with a corresponding flat surface afforded on the at least one seating;

the inclined plane being inclined with respect to the axis of the guide and generating with the axis of the guide a slight tapering of a free end of the at least one tooth destined to couple by insertion thereof in the at least one seating;

wherein the inclined plane is perpendicular to the portion of plane;

wherein the free end of the at least one tooth is delimited by a portion of flat surface which is parallel to at least a portion of flat coupling surface;

wherein the tooth of the coupling element is pushed towards the at least one seating by springs acting parallel to the axis of the guide;

the device further comprising a linear actuator, predisposed coaxially internally of the guide, which linear actuator commands at least an axial uncoupling movement of the at least one tooth of the coupling element from the at least one seating;

and wherein the coupling element is fork-shaped, having two of the at least one tooth, which are identical and symmetrically arranged with respect to a plane containing the axis of the guide, the coupling element being perpendicular to the axis of the pivot when coupling is complete.

2. The device of claim 1, comprising a safety blocking pivot predisposed to block the coupling element to the guide in such a way that a possibility of an axial movement of the coupling element in a continuous and constant taking-up of play is allowed.

3. The device of claim 2, wherein a ratio between a distance of the axis of the guide and the axis of the pivot coupled in the hollow seatings and a distance between the axis and a center of the portion of surface is comprised between 1/10 and 1/2.

* * * * *